United States Patent [19]

Martini

[11] 4,313,054

[45] Jan. 26, 1982

[54] PART LOAD CALCULATOR

[75] Inventor: Richard M. Martini, Solvay, N.Y.

[73] Assignee: Carrier Corporation, Syracuse, N.Y.

[21] Appl. No.: 136,027

[22] Filed: Mar. 31, 1980

[51] Int. Cl.[3] ..... G06C 27/00

[52] U.S. Cl. ..... 235/78 R

[58] Field of Search ..... 235/78 R-78 RC, 235/83, 84, 85 R, 88 R-89 R

[56] References Cited

U.S. PATENT DOCUMENTS 2,373,671 4/1945 Feicht ..... 235/84

2,591,058 4/1952 Freeman ..... 235/84

3,654,436 4/1972 Sansom, Jr. ..... 235/78 N

*Primary Examiner*—L. T. Hix

*Assistant Examiner*—Benjamin R. Fuller

*Attorney, Agent, or Firm*—J. Raymond Curtin; Robert P. Hayter

[57] ABSTRACT

A circular slide rule type calculator is disclosed for calculating various parameters useful in determining operating characteristics of an air conditioning or refrigeration system. A series of four discs each having scales are used to calculate power consumption, load and part load performance factors.

7 Claims, 7 Drawing Figures

PART LOAD CALCULATOR

BACKGROUND OF THE INVENTION

1. Field of the Invention

This invention in general relates to calculators and more particularly to a calculator designed to solve part load problems for air conditioning or refrigeration systems.

2. Prior Art

The selection of a refrigeration system has heretofore been principally made by ascertaining the design load of a building or other device to be conditioned or refrigerated and by matching equipment to that load. The awareness of energy costs has pushed the equipment selector to look for high efficiency equipment under these conditions.

However, it is apparent that most air conditioning equipment does not operate at full design load for more than a minimal period each year. Most of the year operation is under part load conditions wherein the unit is oversized such that some method must be accomplished of producing less than the full unit capability. In addition to simply cycling a unit between on and off typical ways of reducing capacity of the system are cycling the compressors, using compressor cylinder unloaders, and using hot gas bypass. This combination of load limiting devices act to effect the efficiency and performance of the system.

As it becomes more apparent that the energy efficiency and power consumption of a system should not be determined solely at design temperature then part load efficiencies at which the unit is typically operated must also be evaluated. It then becomes necessary to find some method of calculating this part load performance. Heretofore the use of a computer having an emperical data base has been utilized for making these part load calculations. However, the use of the computer brings the inherent disadvantages of accessing the computer, programming and the turn around time period.

The subject matter herein concerns a hand held slide rule type calculator operable to quickly calculate part load performance such that energy consumption and efficiency of the unit can be calculated at various design and off design conditions.

By the use of this calculator it is possible to quickly and in the field ascertain the energy consumption of the unit under operating conditions other than design conditions. It is also possible to determine the capacity of the unit at that part load condition. The calculator, as presented, considers eight variables. These variables are building design load, building partial load, unit or system nominal capacity, unit or system partial capacity, unit or system nominal power, unit or system part load time based average power consumption, design ambient and part load ambient temperature. Entering condenser water temperature may be utilized where appropriate in lieu of the ambient air temperature. This calculator may be used to solve for any one of the unknown variables knowing the other seven. In a typical application of this calculator four of the variables are known and the others are selected to ascertain operation under part load conditions.

SUMMARY OF THE INVENTION

It is an object of this invention to provide a calculator for ascertaining various parameters of air conditioning or refrigeration circuit operation under less than design load conditions.

It is a further object of the present invention to provide a hand held calculator capable of speedy estimation of part load factors.

A further object of the present invention is to provide an economical and quick tool for providing estimations of part load performance in the field.

Other objects will be apparent from the description to follow and the appended claims.

These and other objects are achieved in accordance with the present invention wherein there is provided a circular slide rule type calculating device having four portions. These four portions are concentric discs all pivotally attached at the center. The first portion has a scale acting as a reference scale to indicate part load factors. The second portion has a scale incidating the power consumption of the unit. The third portion has a scale indicating the design capacity of the unit and in addition thereto a series of scales for selecting a part load factor. The fourth portion has a scale for indicating building load and has an indicator connected therewith for coacting with the part load scales of portion three such that a part load factor may be determined from the relative position of those two scales. By combination of all the above portions, it is possible to determine part load power consumption or part load capacity or part load factor assuming the building design condition and assuming enough of the other variables are known or predetermined.

DESCRIPTION OF THE PREFERRED EMBODIMENT

The embodiment described herein will apply to a round, circular slide rule type calculator. It is to be understood that the scales as described may be applied in other embodiments such as a straight slide rule or, in general, in other configurations.

Figure 1:
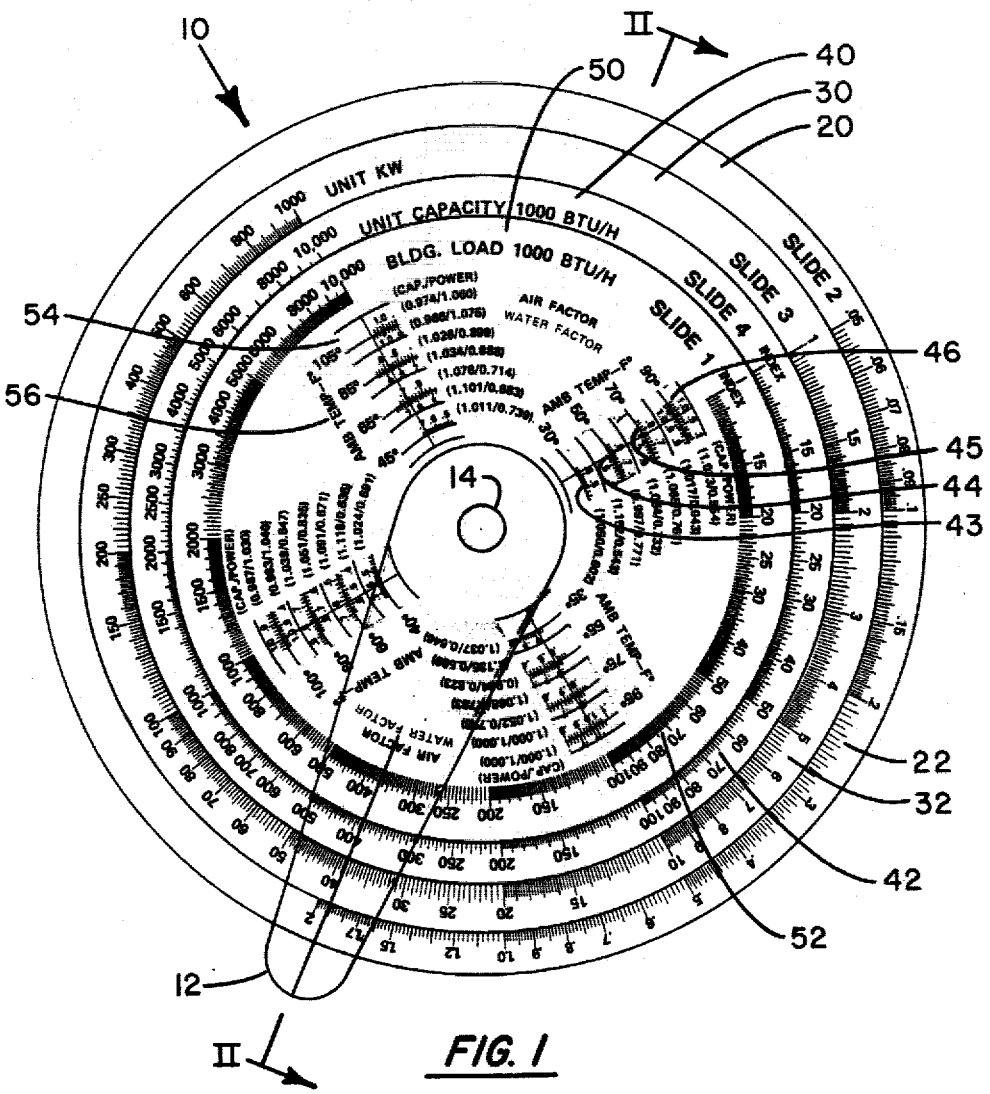
FIG. 1 is a top view of the assembled calculator.
Figure 2:
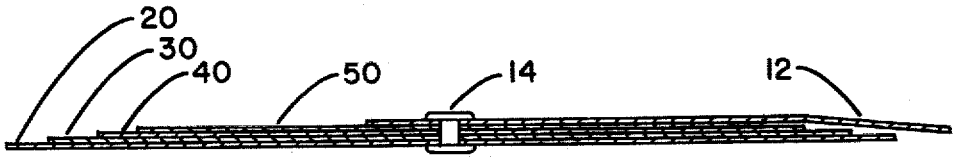
FIG. 2 is a side view of the assembled calculator.
Figure 3:
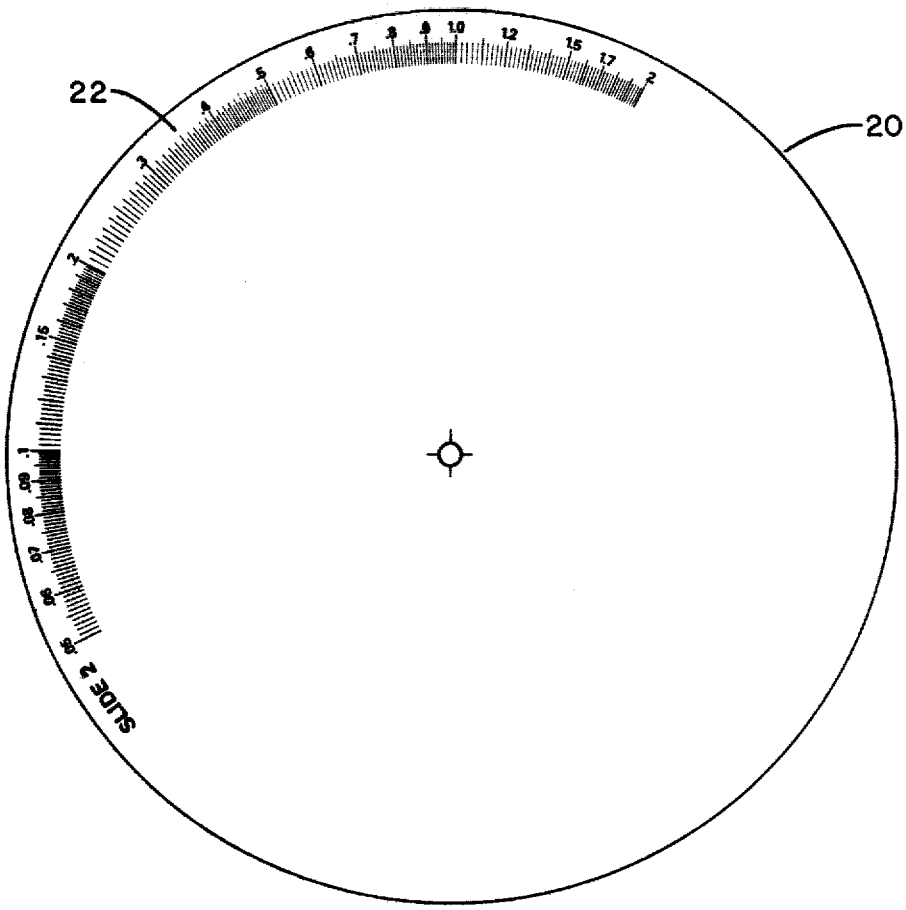
FIG. 3 is a top view of slide two of the calculator.
Figures 4, 5:
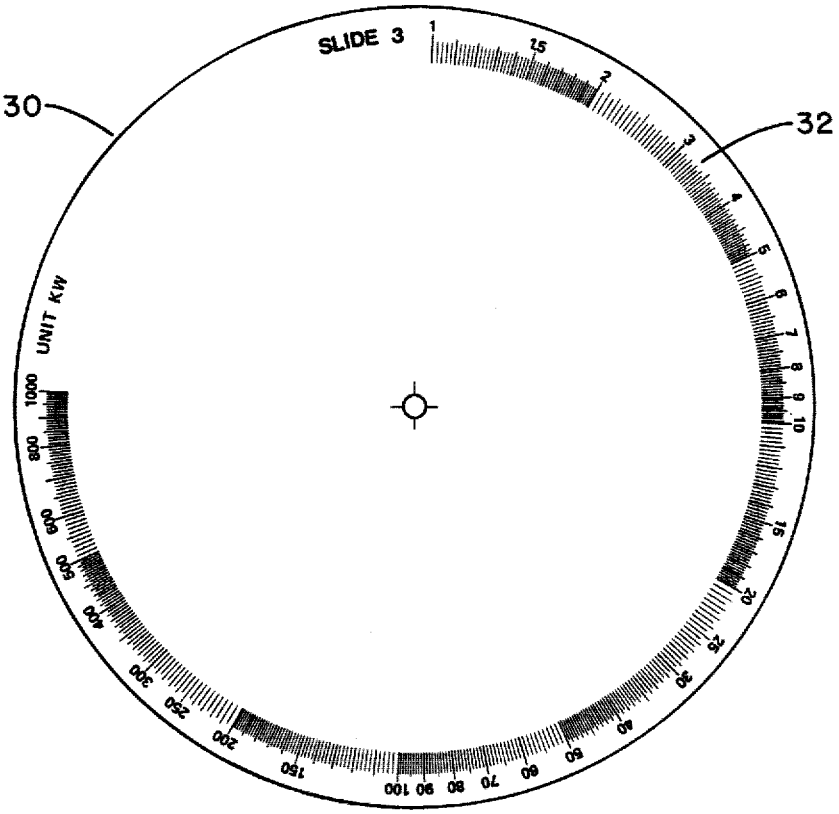
FIG. 4 is a top view of slide three of the calculator.
FIG. 5 is a top view of slide four of the calculator.
Figure 5:
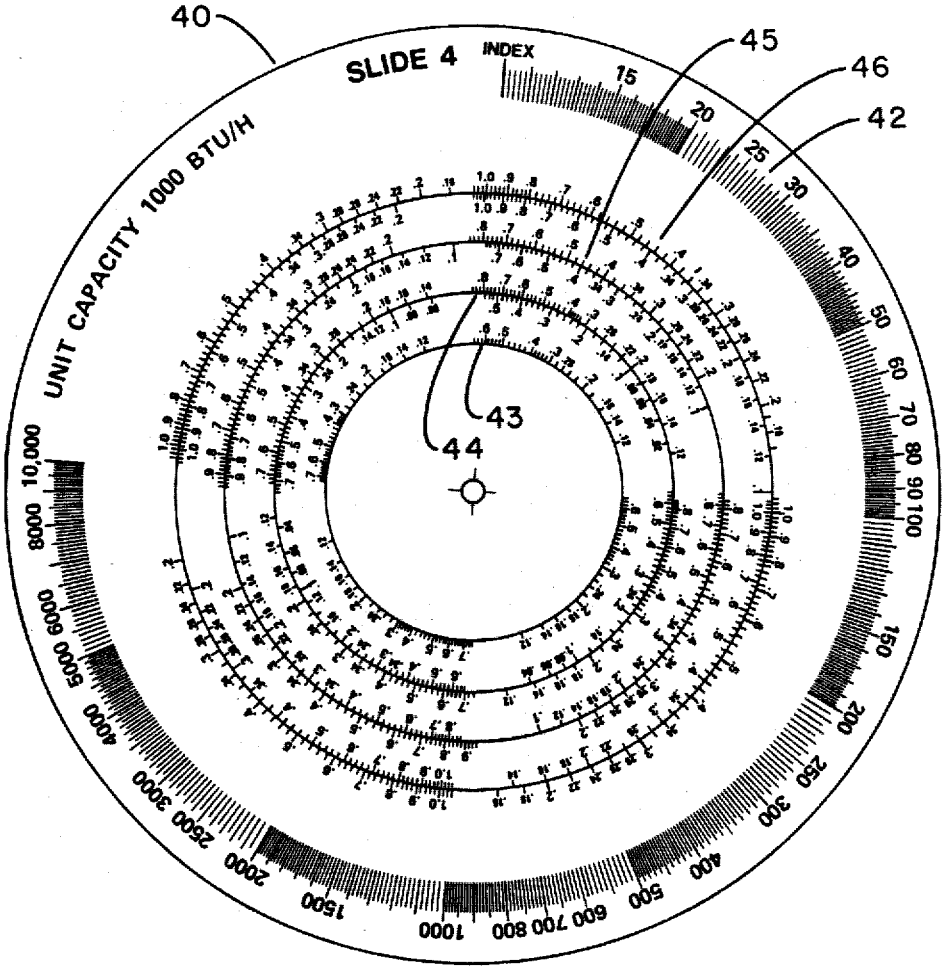
Figure 6:
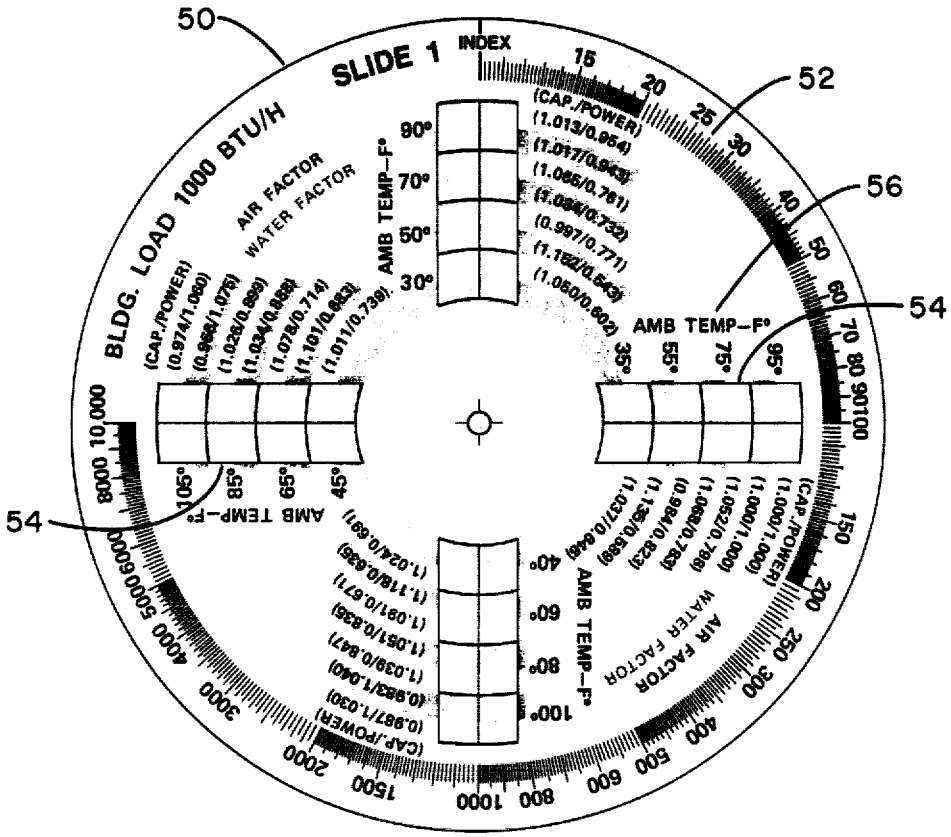
FIG. 6 is a top view of slide one of the calculator.
Figure 7:
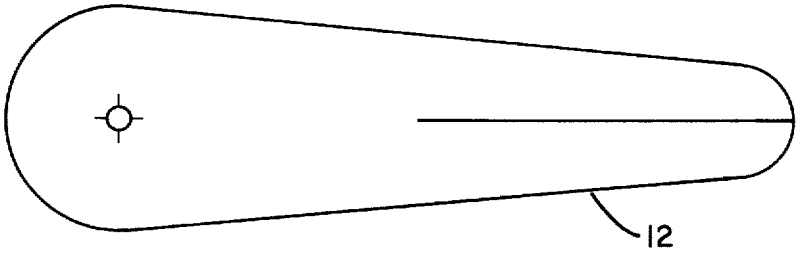
FIG. 7 is a top view of the cursor of the calculator.

The calculator 10 is composed of slide 2 (20), slide 3 (30), slide 4 (40), slide 1 (50) and cursor 12 all secured at the mid points of all the slides by pivot point rivet 14. FIGS. 1 and 2 show the relative positions of the four slides and the cursor.

On slide two which has a greater diameter than slide three and mounted exterior of slide three about the periphery of slide two is scale 22. Scale 22 is a reference scale, as shown herein, ranging in values from 0.05 to 2. Part load factors are referenced on this scale.

Mounted on slide three is scale 32 which indicates the actual power consumption of the air conditioning unit. Scale 32 is mounted on that portion of slide three extending beyond the perimeter of slide four.

Slide four has formed at the periphery thereof scale 42 which indicates the unit capacity of the air conditioning system. Formed interior of scale 42 on slide four are a series of concentric scales 43, 44, 45 and 46 indicating power factors. When assembled, these four scales, 43 through 46 are located beneath slide one such that they are not visible except through the windows of slide one. Each scale 43, 44, 45 and 46 is divided into four quadrants corresponding to the four windows of slide one.

Slide one (50) is located at the top of the calculator assembly and has about the periphery thereof scale 52 indicating building load requirement. Located interior of scale 52 are a series of windows, each window being located over scales 43 through 46 such that a reading therefrom may be taken. Each window is divided into four temperature bins, each bin reading on a separate scale such that depending upon the ambient temperature selected, the appropriate part load factor may be read through that bin of the window. Part load factors for units having either air cooled or water cooled condensing means are both shown in scales 43 through 46 and may be seen through windows 54. Scales 43 through 46 are divided into four quadrants, one for each window of slide one. Under normal usage slide one and slide four will be limited in relative rotation such that each window will allow only values from the appropriate quadrant to be observed therethrough.

Slide one additionally has full load capacity and power consumption factors printed on the face thereof adjacent each temperature bin. If the nominal capacity and/or power consumption of a unit is known then these factors can predict performance at ambient temperatures other than the ambient temperature at the nominal design point.

FIGS. 3 through 6 each show one of the slides. In these figures the details of the scales may be more readily ascertained.

As set forth herein, the slide rule is capable of considering eight variables such that when seven are known the other may be calculated. These variables are building design load, building partial load, unit or system nominal capacity, unit or system partial capacity, unit or system nominal power, unit or system partial power, design ambient and part load ambient. If one of these factors is not known, it may be calculated with this device using the other seven factors. In a typical application the building design load, the unit or system nominal capacity, the unit or system nominal power and the design ambients are all readily known. The part load factor may be calculated with less than the seven other variables and then combined with the other known variables to determine an unknown variable.

The relationship of the building load to the capacity of the unit is used to determine the power factor. These factors have been determined empirically and that data incorporated into scales 42 through 46. Once the overall building load and nominal unit capacity are known and the building load at off design conditions which will be equivalent to the unit delivery at that condition are known then the part load factor may be read from scales 42 through 46 for the appropriate ambient temperature. Having this part load factor then part load power consumption may be calculated using the design power consumption to ascertain the power consumption at part load conditions.

Should the part load power consumption be known, the operation may be worked backwards to determine the part load capacity and building load.

EXAMPLE

The following is an example of the appropriate way to determine power consumption as the ambient temperature changes. First, align the index line of scale one and scale four. This positions scales 43, 44, 45 and 46 in relation to nominal unit capacity. Then set the cursor line for the design load on scale one.

Second, on slide one locate the design ambient air temperature. If working with water cooled systems, equivalent ambient temperature is design entering water temperature plus 10° F. Then find the corresponding full load values adjacent the windows.

Third, holding slides one and four plus the cursor steady, rotate slide two until the capacity full load factor from step two falls under the cursor line.

Fourth, rotate the cursor only so that it falls on a factor of 1.0 on slide two. Thus far we have told the slide rule about the building in relation to nominal conditions.

Fifth, rotate only slide three until the nominal power consumption of the unit or system appears under the cursor hairline.

Sixth, rotate only slide four so that the nominal unit gross capacity finds the cursor hairline. In addition to building data, the rule now knows about the air conditioning system and is balanced with the building at design conditions.

Seventh, to determine part load energy performance for a given ambient, set slide one so that the building load at the new temperature falls under the cursor hairline, read the part load performance factor in the window adjacent to the new ambient on scale one and set the cursor to this factor on slide two and find the power consumption on slide three under the cursor hairline.

If power consumption at another ambient temperature is desired reset the cursor to 1.0 on slide two and repeat the setting of slide one on the building load at the new temperature under the cursor hairline reading the part performance factor in the window adjacent the new ambient on scale one. Then set the cursor to part performance factor on slide two and find the power consumption on slide three under the cursor hairline.

This example is an example of the type of calculation that may be made on this calculator. Any one of the variables other than part load power consumption may likewise be calculated. It is to be understood that although this calculator is described as a circular style slide rule type calculator these same relationships may be engendered in other types of calculators to perform similar or identical functions.

The invention has been described herein with reference to a particular embodiment. It is to be understood by those skilled in the art that various changes may be made and equivalents substituted for the elements thereof without departing from the scope of the invention.

What is claimed is:

1. A device for calculating various operational parameters of an air conditioning or refrigeration system operating at less than full load design conditions which comprises:

a first portion having a first scale for indicating the air conditioning or refrigeration load and having a plurality of indicator means in fixed relationship to the first scale;

a second portion having a second scale for indicating the capacity of the air conditioning or refrigeration equipment and having at least one third scale including a plurality of scales for various ambient temperatures coacting with the indicator means of the first portion for indicating a part load factor at various ambient temperatures;

a third portion having a fourth scale for indicating power consumption of the air conditioning or refrigeration system;

a fourth portion having a reference scale for use in indicating the part load factor; and means for maintaining the first, second, third and fourth portions in a predetermined physical arrangement wherein the first scale, the second scale, the fourth scale and the reference scale are all positioned in juxtaposition to each other.

2. The apparatus as set forth in claim 1 wherein the indicator means of the first portion includes cursor lines on a series of transparent window portions of the first portion and wherein the third scale is located below the window portions of the first portion.

3. The apparatus as set forth in claim 2 wherein the third scale comprises a series of part load scales and wherein the window portion of the first portion is divided into a series of segments, one for each scale, each segment and corresponding scale being used to indicate the part load factor at a preselected ambient temperature.

4. The apparatus as set forth in claim 1 wherein the first, second, third and fourth portions are all cylindrical in configuration and wherein the means for maintaining these portions in position is a fastener located to secure the cylinders to each other at the center point of the surfaces having the scales thereon.

5. The apparatus as set forth in claim 1 wherein the third scale indicates a part load factor for both air cooled and water cooled air conditioning or refrigeration systems at a given ambient temperature.

6. A part load calculator for determining air conditioning system operational parameters at load conditions less than design load of the air conditioning system which comprises:

a series of concentric discs all joined at their centers such that they may rotate with respect to each other, a first disc having a first scale for indicating the building load, a second larger diameter disc having a second scale for indicating the capacity of the air conditioning system, a third disc of larger diameter than the second disc having a third scale for indicating power consumption of the air conditioning system and a fourth disc of a larger idameter than the third disc having a reference scale for indicating part load factors; and means for calculating a part load factor including the second disc defining a part load scale including a plurality of spaced scales corresponding to separate ambient air temperatures and the first disc including an indicator marked on a transparent window portion for selecting the appropriate part load factor when the first disc representing the building load is properly positioned relative to the second disc representing the capacity of the air conditioning system.

7. The apparatus as set forth in claim 6 wherein the part load scale includes a series of part load scales and the first disc includes a series of indicators each corresponding to an ambient temperature and each coacting with a part load scale to indicate the part load factor at that particular ambient temperature.

* * * * *